United States Patent [19]

Nagamoto et al.

[11] Patent Number: 4,529,952

[45] Date of Patent: Jul. 16, 1985

[54] ELECTROMAGNETIC RELAY

[75] Inventors: Mitsuki Nagamoto; Ikuo Hashiya, both of Osaka, Japan

[73] Assignees: Matsushita Electric Works, Ltd., Osaka, Japan; SDS-Elektro GmbH, Deisenhofen, Fed. Rep. of Germany

[21] Appl. No.: 366,046

[22] Filed: Apr. 6, 1982

[30] Foreign Application Priority Data

Apr. 6, 1981 [JP] Japan ..... 56-49418[U]
Apr. 6, 1981 [JP] Japan ..... 56-49419[U]

[51] Int. Cl.[3] ..... H01H 51/22

[52] U.S. Cl. ..... 335/81; 335/80; 335/181

[58] Field of Search ..... 335/78, 79, 80, 81, 335/82, 83, 84, 85, 179, 180, 181, 202

[56] References Cited

U.S. PATENT DOCUMENTS 2,951,134 8/1960 Lazich ..... 335/81
3,717,829 2/1973 Flaherty ..... 335/202

*Primary Examiner*—Harold Broome
*Attorney, Agent, or Firm*—Schwartz, Jeffery, Schwaab, Mack, Blumenthal & Koch

[57] ABSTRACT

An electromagnetic relay comprises a bobbin carrying a coil and having a longitudinal central bore through which an armature extends. A permanent magnet is disposed between the central webs of two generally U-shaped yokes, the legs of the yokes having end portions cooperating with end sections of the armature which project from the central bore of the bobbin. The armature is pivotal about a fulcrum formed near its one end, whereas the other end of the armature carries an actuating card for driving a contact spring disposed at the side, and parallel to, the bobbin. The contact spring is fixed at one end to a first contact terminal and has its other end disposed between two fixed contacts connected to second and third contact terminals. The three contact terminals are disposed along a line generally extending parallel to the bobbin. The coil is connected to two or three coil terminals arranged at the other side of the bobbin along a line which also extends generally parallel to the bobbin. The bobbin with the armature extending through its central bore, the yokes and the permanent magnet are together press-fitted in a recess of a base in which the contact and coil terminals are embedded.

8 Claims, 4 Drawing Figures

ELECTROMAGNETIC RELAY

BACKGROUND OF THE INVENTION

This invention relates to a polarized electromagnetic relay of the type in which a armature extends through a longitudinal bore of a bobbin carrying a coil, and a permanent magnet is disposed between a pair of pole shoes, the armature being actuated by the combination of the magnetic flux created by the permanent magnet and that created by energization of the coil.

In prior art relays of this type, the armature is formed by a resilient contact reed which has one end projecting from the bobbin bore fixed to a contact terminal and the other, free end disposed between a pair of fixed contacts connected to further contact terminals. The fixed contacts at the same time form pole shoes of a permanent magnet which is generally disposed in the longitudinal direction defined by the bobbin.

Due to the disposition of the bobbin, the contact system and the permanent magnet in the same longitudinal direction, the length of the resilient contact reed is restricted at a given overall length of the relay. The reed is therefore more strongly influenced by fluctuations in the spring load, which creates problems with respect to a stable operation.

At the same time, the comparatively small actual length of the coil restricts the magnetic flux to be created by the coil at a given coil current.

The rather small cross-sectional area which the contact reed extending through the bobbin must have to obtain the required resiliency, is disadvantageous in view of the correspondingly high magnetic resistance which the armature formed by the reed presents to the combined coil and permanent fluxes.

In the above-described prior art relays, the coil and contact terminals are usually disposed in such a manner that pairs of these terminals formed in the lateral direction of the relay are used as coil terminals and contact terminals. With such an arrangement, the spacing between a contact terminal and a coil terminal becomes comparatively small at certain locations, which is unfavourable from the standpoint of keeping influences from the energizing circuit on the circuit switched by the relay at a minimum.

It is an object of the present invention to provide an electromagnetic relay which is stable in operation and of high sensitivity at small overall dimensions.

It is a further object to devise an electromagnetic relay in which the insulating distances between the contact terminals and the coil terminals are made large.

As another object of the invention, an electromagnetic relay is to be provided, which is easy to assemble from a minimum of individual structural elements.

SUMMARY OF THE INVENTION

The electromagnetic relay according to the present invention includes (a) a bobbin carrying a coil connected to a pair of coil terminals, the bobbin having an inner bore along a longitudinal direction of the bobbin, (b) an armature extending through said bore, (c) a pair of yokes extending along said longitudinal direction and a permanent magnet disposed between the pair of yokes for energizing said armature, (d) a movable contact arranged laterally of said bobbin and having a first end connected to a first contact terminal and a second end disposed for cooperation with at least one fixed contact connected to a second contact terminal, and (e) an actuating means fixed to said armature and engaging said movable contact for driving the movable contact into and out of engagement with said fixed contact upon energization of said coil.

In the relay of the present invention, the armature and the movable contact may be designed individually in accordance with their respective functions. Furthermore, the armature extending through the coil bobbin, the permenent magnet, and the movable contact all extend substantially parallel to each other in the longitudinal direction of the relay, so that they may all take substantially the entire length of the relay, with the result that a stable and sensitive relay operation is obtained by permitting a powerful coil, a powerful permanent magnet and a movable contact of highly constant operation characteristics. The lateral disposition of the contact system, the coil and the coil terminals further allows maximum spacing between the contact terminals on the one side and the relay terminals on the other side.

Further objects and advantages of the invention will become apparent from the following detailed description.

DETAILED DESCRIPTION OF A PREFERRED EMBODIMENT

Figure 1:
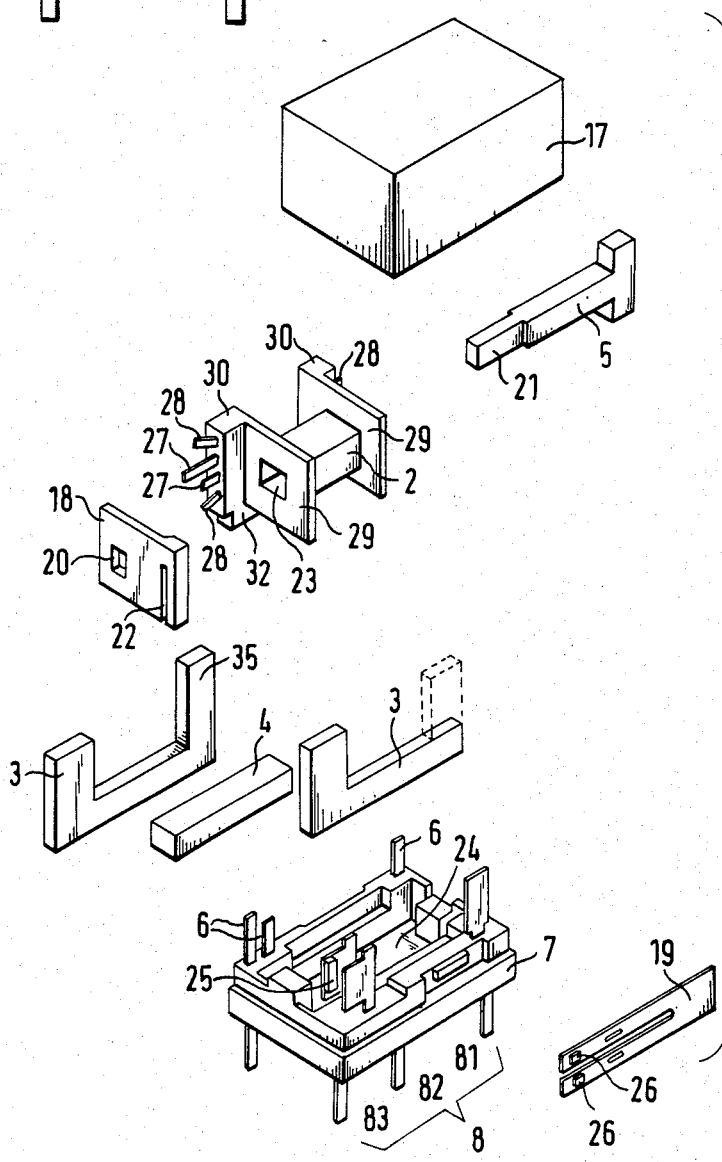
FIG. 1 is an exploded view of a relay according to a preferred embodiment of this invention.
Figure 2:
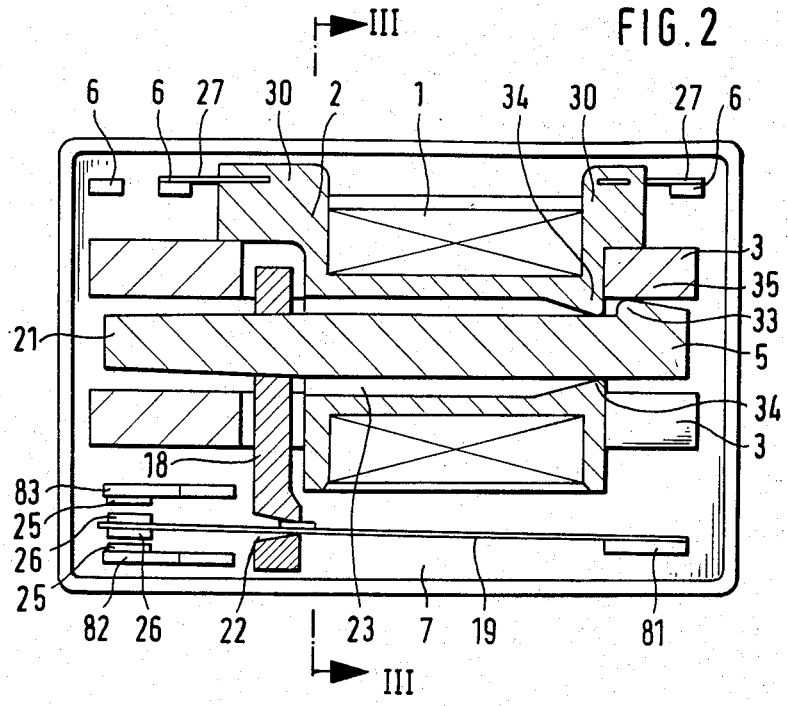
FIG. 2 is a cross-section taken along a longitudinal, vertical plane of the relay of FIG. 1 in its assembled state.

As shown in the drawings, particularly in FIGS. 1 and 2, a coil 1 is wound on the central trunk of a bobbin 2. An armature 5 extends through a central longitudinal bore 23 of the bobbin 2 and has a tip portion 21 projecting from the bore 23 and penetrating a hole 20 provided in an actuating card 18 in such a manner that the card 18 is fixed to the armature 5.

An elongate permanent magnet 4 is disposed between the central webs of a pair of generally U-shaped yokes 3 which are disposed under the bobbin 2 in FIG. 1 and extend parallel to the bore 23. Vertically upright legs of the yokes 3 are disposed close to the tip portion 21 of the armature 5 and, respectively, to the opposite end (root) of the armature 5 which projects from the other end of the bore 23.

Figure 4:
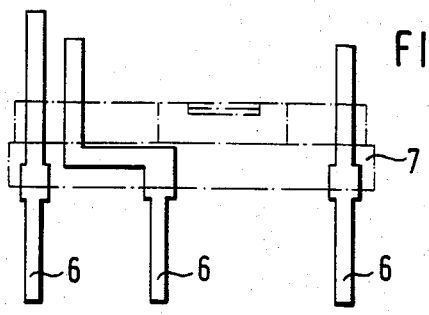
FIG. 4 is a representation of the coil terminal arrangement in the relay according to FIGS. 1 to 3.
Figure 3:
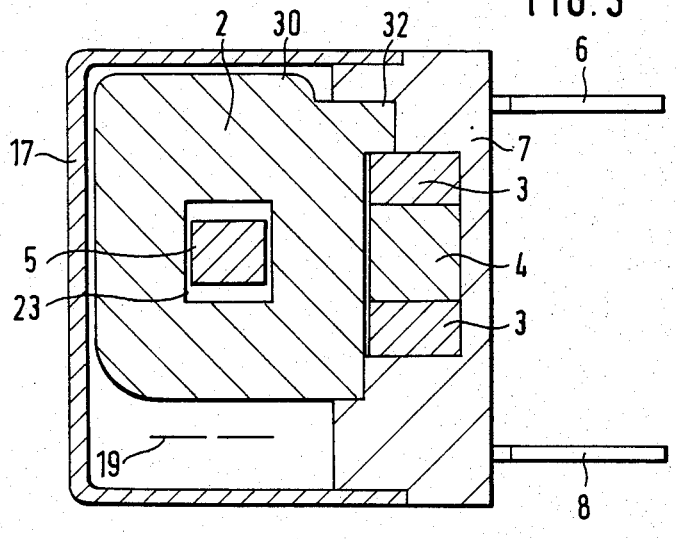
FIG. 3 is a cross-section taken along the line III—III in FIG. 2.

As shown in FIG. 3, the yokes 3 and the interposed permanent magnet 4 as well as a downward projection 32 of the bobbin 2 are press-fitted into a correspondingly shaped recess 24 of a base 7 of the relay. Three coil terminals 6 are embedded in the body 7 on one side of the bobbin 2, and contact terminals 81, 82 and 83 are embedded in the body 7 at the other side of the bobbin. As shown in FIGS. 1 and 2, the coil and contact terminals extend from the lower side of the body 7 with the coil terminals 6 and the contact terminals 81 to 83 each being aligned along a straight line. The coil terminals 6 are shown in greater detail in FIG. 4.

All three coil terminals are used in case the coil 1 comprises two sections with a center tap, which is connected to the middle terminal 6. Such a coil having two sections energized in opposite directions may be employed for bistable relays. On the other hand, in case of a monostable relay, the coil 1 will have just one common winding connected between the two end terminals 6.

As shown in FIGS. 1 and 2, the bobbin 2 has stepped portions 30 formed at one side of the two end flanges of the bobbin in which U-shaped connecting plates are embedded. Each connecting plate has two legs 27, 28 which project from the flange portion 30. The legs 28 are soldered to the ends and center tap (if such is provided) of the coil winding, whereas the legs 27 serve for connection with the coil terminals 6 by soldering or welding. As shown in FIG. 1, the legs 27 projecting from the left-hand bobbin portion 30 have different lengths so as to meet the upper ends of the two left-hand coil terminals which are also different in length.

On the other side of the bobbin opposite the coil terminals 6, contact terminals 81, 82 and 83 are embedded in the base 7 and project downwardly from the lower surface thereof generally along one common line parallel to the longitudinal axis defined by the bobbin 2. Thus, the group of coil terminals 6 and of the contact terminals 81, 82 and 83 are disposed parallel to each other at both sides of the base 7.

The contact terminal 83 is bent in such a manner that its upper portion is located opposite to the upper portion of the contact terminal 82. Fixed contacts 25 are attached to those upper portions of the terminals 82 and 83 and cooperate with movable contact portions 26 attached at the free end of a movable contact spring 19 which is fixed at its root to the upper portion of the contact terminal 81. As shown in FIG. 1, the contact spring is made of a resilient metal strip and bifurcated towards its free end.

At a location near the contact portions 26, the spring 19 is fitted into a downwardly open slot 22 provided in a side portion of the actuating card 18 fixed to the armature 5.

Referring to FIG. 2, the bobbin 2 is provided at the right-hand end with projections 34 extending into the bore 23 and forming a loose bearing for the armature 5. At the root of the armature 5 extending outwardly of the bore to the right side in FIG. 2, a nose 33 is formed which abuts the vertical leg 35 of the yoke 3 (also shown in FIG. 1) to form a fulcrum for the armature 5.

A cap 17 shown in FIG. 1 cooperates with a stepped portion of the base 7 to house and seal all structural elements of the relay.

In the drawings, a monostable polarized electromagnetic relay is shown. In this monostable version, only one of the yokes shown in FIG. 1 is provided with two vertical legs, of which one is designated by reference number 35. The other yoke is actually L-shaped with the right-hand vertical leg omitted. Accordingly, only one nose 33 is formed at the root of the armature 5 as shown in FIG. 2. In this monostable version, the armature 5 will assume a rest position (when the coil 1 is not energized) in which the nose 33 contacts the leg 35 of the upper yoke 3 in FIG. 2 and the tip portion 21 of the armature 5 is situated close to the lower yoke 3. In this position, the actuating card 18 presses the contact spring 19 downwardly so that the movable contact portion 26 will engage the normally-closed fixed contact portion 25 provided on the contact terminal 82. When the coil is energized, the flux created by the coil will reverse the polarization of the armature 5 thereby tilting the armature 5 about the fulcrum formed between the nose 33 and the leg 35. At the end of this tilting motion, the nose 33 will come clear of the leg 35, and the tip portion 21 of the armature 5 will approach the upper yoke 3 in FIG. 2. During this last portion of the tilting motion, the projection 34 of the bobbin 2 will serve as a pivot for the armature 5. For such a monostable relay, one single coil winding is necessary which is connected to the two outer coil terminals 6.

In a bistable version of the relay, the yoke 3 will be symmetrical, i.e. the right-hand yoke 3 will be provided with a second vertical leg as shown in dotted lines in FIG. 1. Moreover, two noses 33 (the second one being also shown in dotted lines in FIG. 2) will be provided on opposite sides of the root of the armature 5 opposing the two vertical legs of the yokes 3. In this case, the coil 1 comprises two sections connected in series, the center tap of the coil being now connected to the middle coil terminal 6. The two coil sections will carry current selectively and in opposite directions. As an alternative, one single coil may be connected so that it conducts current in either direction depending on the switching direction to be achieved.

In FIG. 2, the armature 5 and the contact spring 19 are shown in a central position which occurs only transitionally during the change-over movement, unless additional means (not shown) are provided to define a neutral center position in a bistable relay.

As shown most clearly in FIG. 2, the spacing between the group of coil terminals 6 and the group of contact terminals 81 to 83 is substantially equal to the entire width of the relay base 7. Accordingly, due to the design of this relay, maximum spacing is obtained thereby minimizing the risk of influences between the two current circuits, and even more the risk of short circuits therebetween.

Furthermore, due to the parallel disposition of the coil 1, the permanent magnet 4 and the contact spring 19, all of these elements may be formed with a considerable axial length thereby reducing fluctuations of the spring load to obtain a polarized relay of compact design, stable operation and high sensitivity.

What is claimed is:

1. An electromagnetic relay including (a) a bobbin carrying a coil connected to a pair of coil terminals, the bobbin having an inner bore along a longitudinal direction of the bobbin, (b) an armature extending through said bore, (c) a pair of yokes extending along said longitudinal direction and a permanent magnet disposed between the pair of yokes for energizing said armature, (d) a movable contact arranged laterally of said bobbin and having a first end connected to a first contact terminal and a second end disposed for cooperation with at least one fixed contact connected to a second contact terminal, and (e) an actuating means fixed to said armature and engaging said movable contact for driving the movable contact into and out of engagement with said fixed contact upon energization of said coil;

wherein said bobbin has at one of its longitudinal ends projections extending into said bore to form a loose bearing for said armature, an end portion of said armature extending from said bore being provided with at least one lateral nose cooperating with a respective one of said yokes to form a fulcrum for said armature.

2. The relay of claim 1, wherein said coil terminals and contact terminals are mounted on a base, said coil terminals being disposed at one side and said contact terminals at the other side of the bobbin with respect to said longitudinal direction.

3. The relay of claim 2, wherein said base has a recess shaped to receive said bobbin, yokes and permanent magnet in a press-fit manner.

4. The relay of claim 1, wherein said yokes are assymmetrical with respect to said armature.

5. The relay of claim 1, wherein said second end of said movable contact is disposed between a pair of fixed contacts, said yokes are symmetrical with respect to said armature, and said coil is adapted to magnetize the armature in either longitudinal direction.

6. The relay of claim 5, wherein said coil includes a middle tap connected to a third coil terminal.

7. The relay of claim 1, wherein said movable contact includes a contact spring extending substantially parallel to said bobbin and essentially over the entire length of said base.

8. The relay of claim 1, wherein said yokes are generally U-shaped, including middle webs extending parallel to said armature and legs extending from said middle webs and having end portions cooperating with end portions of said armature projection from said bore.

* * * * *